US009096417B2

(12) United States Patent
Sand

(10) Patent No.: US 9,096,417 B2
(45) Date of Patent: Aug. 4, 2015

(54) MODULAR CHEMICAL DISPENSING SYSTEM AND METHODS

(75) Inventor: William F. Sand, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 488 days.

(21) Appl. No.: 12/899,143

(22) Filed: Oct. 6, 2010

(65) Prior Publication Data

US 2012/0085785 A1 Apr. 12, 2012

Related U.S. Application Data

(60) Provisional application No. 61/278,504, filed on Oct. 7, 2009.

(51) Int. Cl.

| | |
|---|---|
| ***B67D 7/84*** | (2010.01) |
| ***B67D 7/02*** | (2010.01) |
| ***A47F 1/08*** | (2006.01) |
| ***A47F 5/08*** | (2006.01) |

(52) U.S. Cl.
CPC ... *B67D 7/02* (2013.01); *A47F 1/08* (2013.01); *A47F 5/08* (2013.01)

(58) Field of Classification Search
CPC ..... A47F 5/08; A47F 1/08
USPC ..... 222/173, 180, 181.1, 181.2, 160, 222/153.01–153.04, 181.3, 183, 138–142; 29/428; 211/97, 87.01, 90.01, 94.01, 211/94.02, 99–104
See application file for complete search history.

(56) References Cited

U.S. PATENT DOCUMENTS

| | | | | |
|---|---|---|---|---|
| 2,428,073 | A * | 9/1947 | Handel | 211/119.004 |
| 4,287,921 | A * | 9/1981 | Sanford | 141/360 |
| 4,763,494 | A * | 8/1988 | der Kinderen | 68/17 R |
| 4,874,113 | A * | 10/1989 | Schmidt | 222/143 |
| 5,485,932 | A * | 1/1996 | Romm et al. | 211/87.01 |
| 5,791,525 | A * | 8/1998 | Fan | 222/181.3 |
| 6,367,213 | B1 * | 4/2002 | Reuter et al. | 52/239 |
| 6,962,272 | B2 * | 11/2005 | LeBlond | 222/180 |
| 7,051,987 | B2 * | 5/2006 | Chen | 248/447.1 |
| 7,147,129 | B1 * | 12/2006 | Menefield | 221/283 |
| 7,290,683 | B2 * | 11/2007 | Gerenraich | 222/180 |
| 7,549,893 | B1 * | 6/2009 | Walker et al. | 439/532 |
| 7,954,761 | B2 * | 6/2011 | Johnson et al. | 244/118.5 |
| 8,123,149 | B2 * | 2/2012 | Tognetti et al. | 239/310 |
| 2007/0289225 | A1 * | 12/2007 | Kern et al. | 52/36.1 |
| 2008/0083786 | A1 * | 4/2008 | Marin | 222/181.3 |
| 2009/0120951 | A1 * | 5/2009 | Titas et al. | 221/45 |

* cited by examiner

*Primary Examiner* — Lien Ngo
(74) *Attorney, Agent, or Firm* — Wood, Herron & Evans, LLP

(57) ABSTRACT

A modular chemical dispensing system includes a plurality of rail members combining to define a wall-mounted grid for supporting dispensing and chemical source modules. The grid is easily secured to a wall and the modules moved laterally onto the grid with rotatable locks securing the modules to the rails. Chemical source modules have lockable doors preventing unauthorized access to chemicals therein and preventing unauthorized module removal. A variety of module configurations are provided, reducing inventories of custom parts. Methods are disclosed.

10 Claims, 17 Drawing Sheets

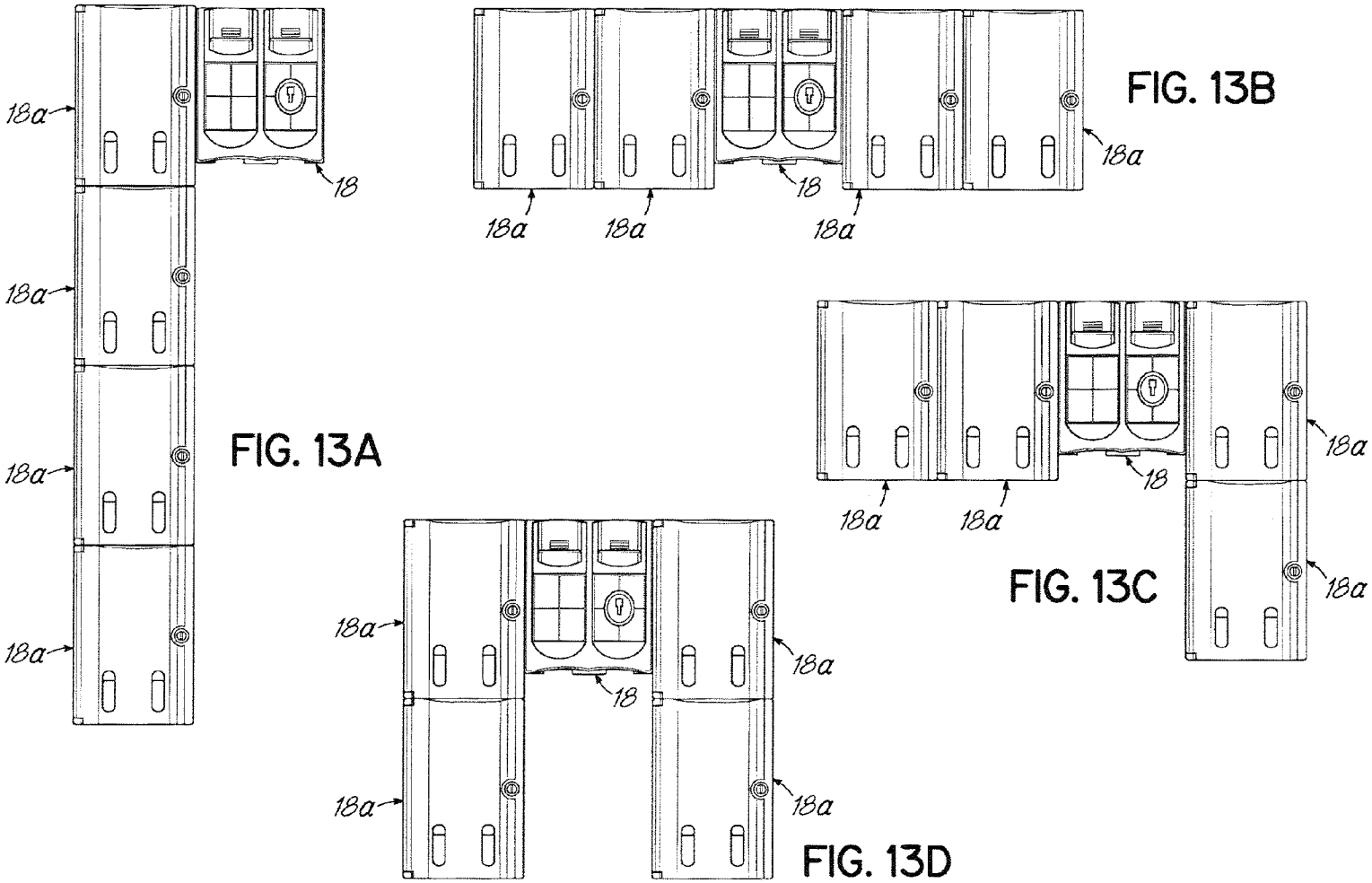
18
18a
18a
18a

MODULAR CHEMICAL DISPENSING SYSTEM AND METHODS

PRIORITY CLAIM

Applicant claims the benefit of the filing date of U.S. provisional patent application Ser. No. 61/278,504 entitled MODULAR CHEMICAL DISPENSING SYSTEM AND METHODS filed Oct. 7, 2009, which application is incorporated herein by express reference as if fully expressed and set out fully herein.

FIELD OF THE INVENTION

There are numerous factors that are important in maintaining a building and in keeping it clean. These include, for example, lawn service, heating and air-conditioning and general repairs. Another service that is usually performed on a daily basis is cleaning. In some instances such as restaurants or hotels this task is performed many times throughout the day. The individuals who perform these tasks typically use a variety of chemical cleaners to accomplish their tasks easily and efficiently. These chemical cleaners are typically mixed from concentrates with the use of onsite chemical mixing systems. These systems are supplied by a number of chemical mixing system manufacturers such as, Hydro Systems Co., Dema Engineering Co and Knight Manufacturing Company, for example. Each of these companies makes chemical mixing systems that are installed in a variety of commercial buildings and facilities.

BACKGROUND OF THE INVENTION

Chemical mixing systems are typically comprised of a dispenser which is enclosed in a housing or cabinet. In addition to the dispenser, the mixing system may include additional space to accommodate concentrated chemical containers operationally connected to the dispensers. Such systems may also comprise several cabinets, one or more dispensers and a plurality of cabinets to hold the chemical concentrates. These units are typically installed in janitors' closets and kitchens. These closets are small and sometimes are used to store various materials. The closets may include shelves for storing said materials. Available space for mounting dispensing systems in these areas is thus usually at a premium.

One such system on the market now includes a combinations of dispensing units and chemical container enclosures and is produced by the Hydro Systems Company of Cincinnati, Ohio, One example is an apparatus marketed by that company under the mark "Maximizer". Such dispensing system incorporates a dispenser and an enclosure for the chemical. These units are typically built to custom size and function in the factory and shipped as a single unit, taking into account specific needs or requirements. Since each unit is typically custom built in order to meet the parameters of the space in which it will be mounted and the particular dispenser specifications of the customer, the time required by the manufacturer to produce and assemble the units adds to the delivery time of the unit. Since the units are shipped as a completed unit they cannot be reconfigured in the field to suit the unique installation requirements of each facility, thus creating the need to order additional units with different spatial configurations, and increasing the time to get the product installed.

Installation of such prior units is typically accomplished by holding the unit to the wall, opening the enclosure door and using the mounting holes in the unit cabinet as a template and marking the wall for mounting screws when holes are drilled.

The cabinet is then positioned and mounting screws applied. This procedure is frequently very difficult because of the size of the units, typically cramped spaces and the difficulty of holding the units in place before the mounting fasteners are applied.

Other systems on the market have addressed the mounting issue. In particular is the Hydro Systems Company product marketed under the mark "Taskmizer". This unit uses a plastic or metal mounting bracket that is first mounted to the wall. The back of dispensing unit is then aligned flush with the wall and slightly above the mounting bracket. The unit is lowered to engage mating parts on the back of the cabinet with respective mounting parts on the bracket. A screw is then installed into the cabinet to secure it to the wall. While this is an improvement over the using the cabinet as a template, there are other disadvantages to such systems. The installation requires the cabinet to be initially typically above the mounting bracket and then lowered in a downward direction to engage the mounting bracket. If there is a shelf or other obstruction above the cabinet, the mounting bracket must be positioned far enough below it to thus allow a space between the shelf and the dispensing system to accommodate mounting. This is a waste of wall space. These units also require the use of a screw to assure that the units cannot be removed from the wall.

Many of these systems make use of locks on the access door of the chemical storage cabinets. The locks prevent unauthorized personnel from accessing these concentrated chemicals. These chemicals are sometimes toxic and expensive. Unauthorized use may cause safety hazards and/or loss of money. If the unit is locked but not so secured to the wall that theft of the unit and chemical is not a possibility, then the units could be easily removed by unauthorized persons even if the lock was not defeated.

The Hydro Systems Co. "Taskmizer" brand product has addressed the need to be able to configure the system for certain individual installations by separating the dispensing unit from the chemical concentrate container. This system allows the dispenser to be mounted to the wall and then the chemical cabinets installed separate from the dispenser. A separate wall bracket is required, however, for each component. Measuring is thus needed to accurately install the components in close proximity to each other. This is especially difficult to perform when the cabinets are mounted above one another.

Accordingly, what is needed is a dispensing and chemical source storage system which can be configured and easily mounted at the point of use to serve a variety of dispensing applications without the space and mounting issues noted above. Moreover, it is desired to provide a mounting apparatus and methods enabling commonly structured cabinets and mounting components to fit a large variety of mounting options, reducing the necessity for custom manufacturing at the factory. It is also desired to provide a secure mounting apparatus, making unit removal more difficult to unauthorized persons.

SUMMARY OF THE INVENTION

The Modular chemical dispenser and methods of this invention address the issue of configurability, that is, the ability to customize and install the system components in different ways at the point of use, and without individual customization when manufactured. It also addresses the issue of safety and pilferage of material by locking the system components to the wall without the use of additional screws. In addition, the mounting system, based on lateral mounting without vertical motion, allows zero clearance mounting to adjacent obstructions, particularly above the units. The ability to build or configure the system on site rather than at the manufacturer reduces the number of parts that need to be inventoried thus reducing costs.

The basic structural components of the invention include a multiple piece mounting grid with an optional number of horizontal rails or rail frames. Vertical spacer rails and rail connectors serve to position the horizontal rails and define mounting points for dispensing and chemical container cabinets or modules, which are wholly arbitrary and can fit a huge variety of available space, system support, walls. In use, a predetermined number of rails are provided and the installer simply mounts them in a desired configuration in the available wall space. Connectors space and position the rails at appropriate component distances both horizontally and vertically. Upon installation, the modules are presented in lateral direction to the rails. Rotatable hooks or latches in the cabinets then lock the components to the rails once the components are pushed laterally or horizontally onto the rails. Modules can thus be mounted directly under or over shelves or other obstructions; no vertical motion is necessary to mount them onto the rails, nor to lock them on the rails.

The invention is illustrated in FIGS. 1 through 13*d*.

BRIEF DESCRIPTION OF THE DRAWINGS

FIGS. 13A-13D are further elevational views illustrating further module mounting orientations.

DETAILED DESCRIPTION OF THE INVENTION

Figure 1:
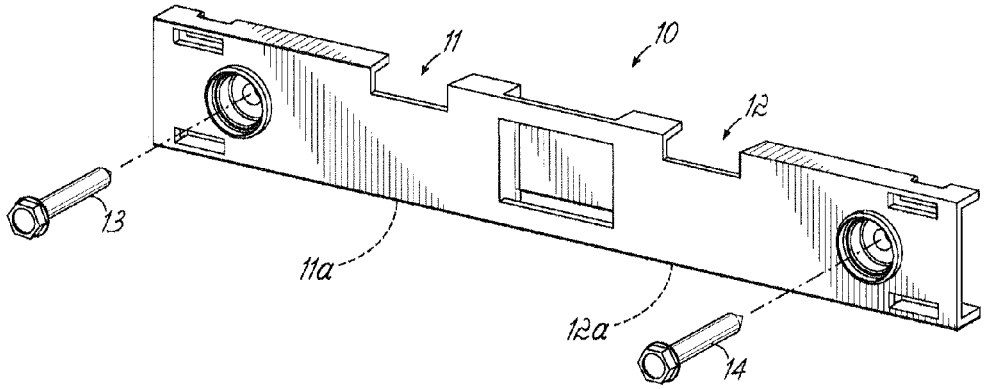
FIG. 1 is an isometric view of a dispenser mounting rail.

Turning now to the figures, the invention contemplates a plurality of configurable rail components illustrated in FIGS. 1, 4-4B, 5, 8-8B, 10 and 11B as well as in others of the figures. A single dispenser mounting rail is shown in FIG. 1 and has two lock notches 11, 12 or openings providing access to the cabinet locks to be described. It will be appreciated that notches 11, 12 in rail 10 (and like notches in other rail components of the invention) have complimentary notches 11*a*, 12*a* (not shown in FIG. 1) in the underside of the rail 10 to accommodate notable latches from the bottom of the rail where desired. Screws applied through holes as shown secure the rail to a wall surface. The view of FIG. 1 illustrates the front of rail 10 to which a cabinet component will be applied.

Figure 2:
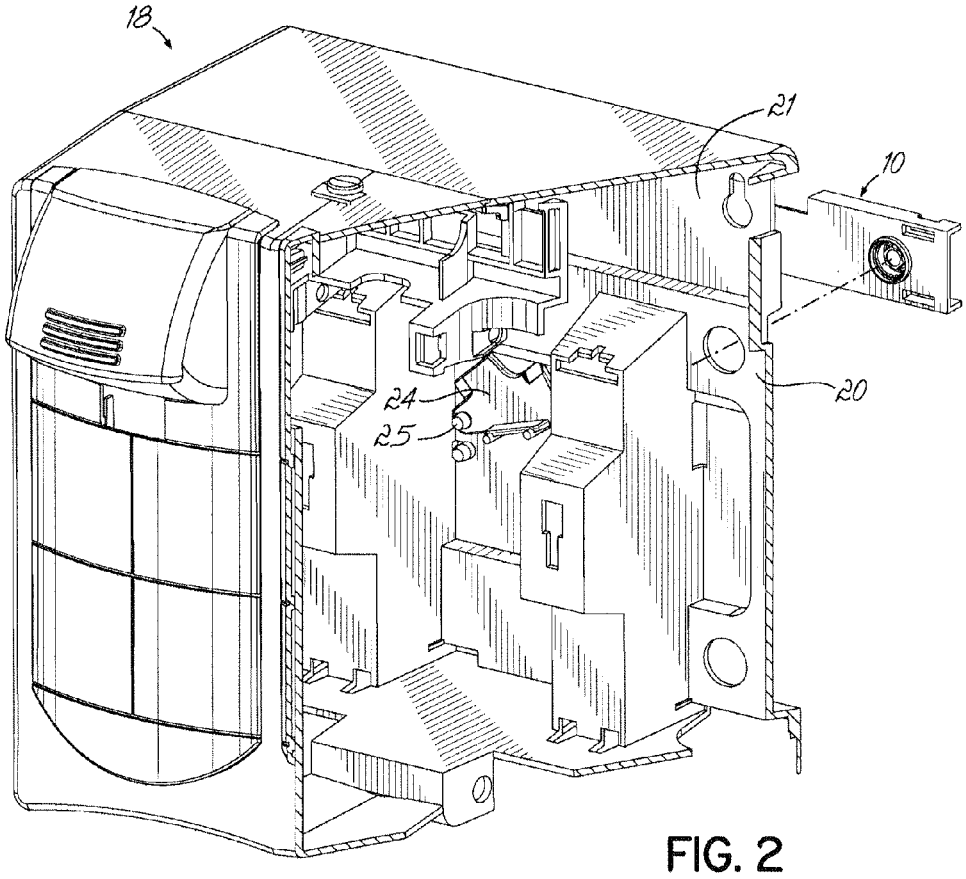
FIG. 2 is a cut-away view of a dispenser module mounted to a dispenser mounting rail and showing a mounting lock.

FIG. 2 illustrates a dispenser cabinet assembly or module 18 in cut-away view for mounting on a dispenser mounting rail 10 (spaced apart in FIG. 2). A mounting channel 20 is formed in the rear wall 21 of this module 18 to accommodate the rail 10. Upon assembly, the module 18 is moved rearwardly in a horizontal motion onto the rail 10 which is secured to a wall. One rotatable mounting lock 24, pivoted about lock pin 25, is shown here, the lock 24 rotated to disengaged position under a rail 10.

It will be appreciated this module 18 may house or support a dispensing apparatus which may include a diluent connector, a selector valve, a proportioner and a depending discharge spout, all operably interconnectable through respective tubing to a diluent source and to concentrated chemical sources. Such components are well known, and are not shown here for purposes of clarity.

Figure 3:
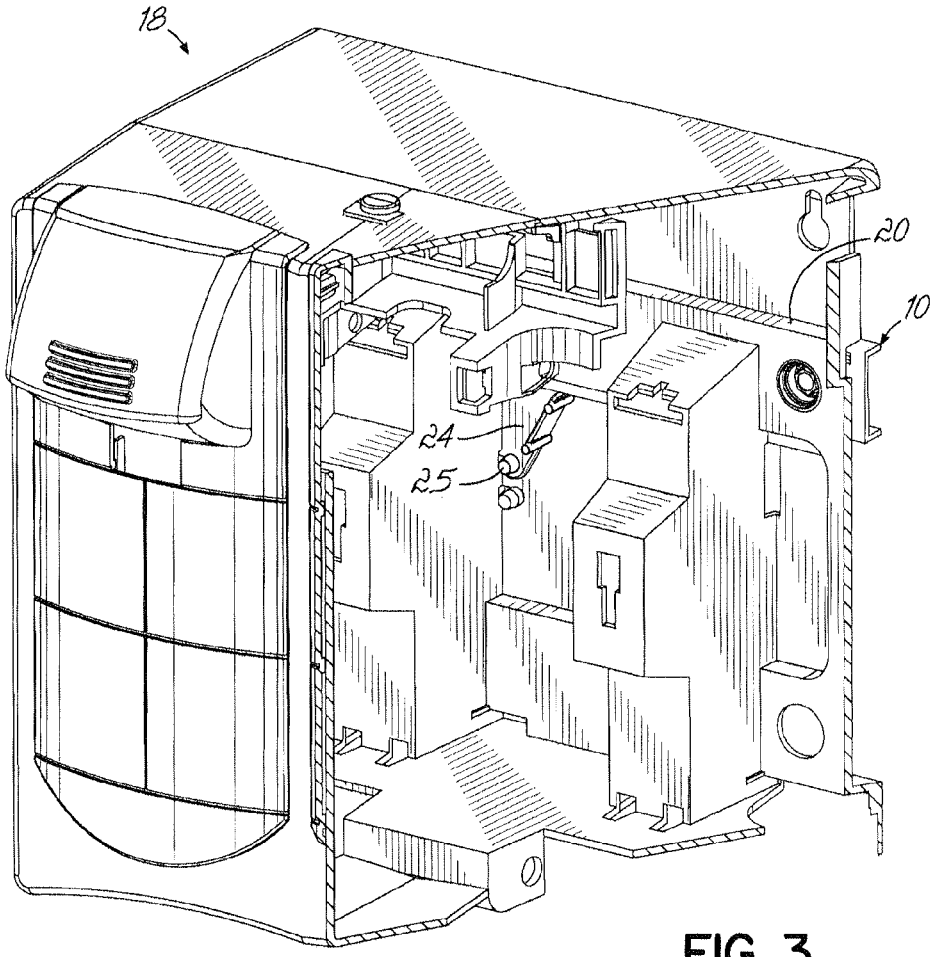
FIG. 3 is a view similar to FIG. 2, but showing the mounting lock pivoted for engagement.

FIG. 3 illustrates the dispenser assembly of FIG. 2 mounted on the dispenser mounting rail.

Figure 4:
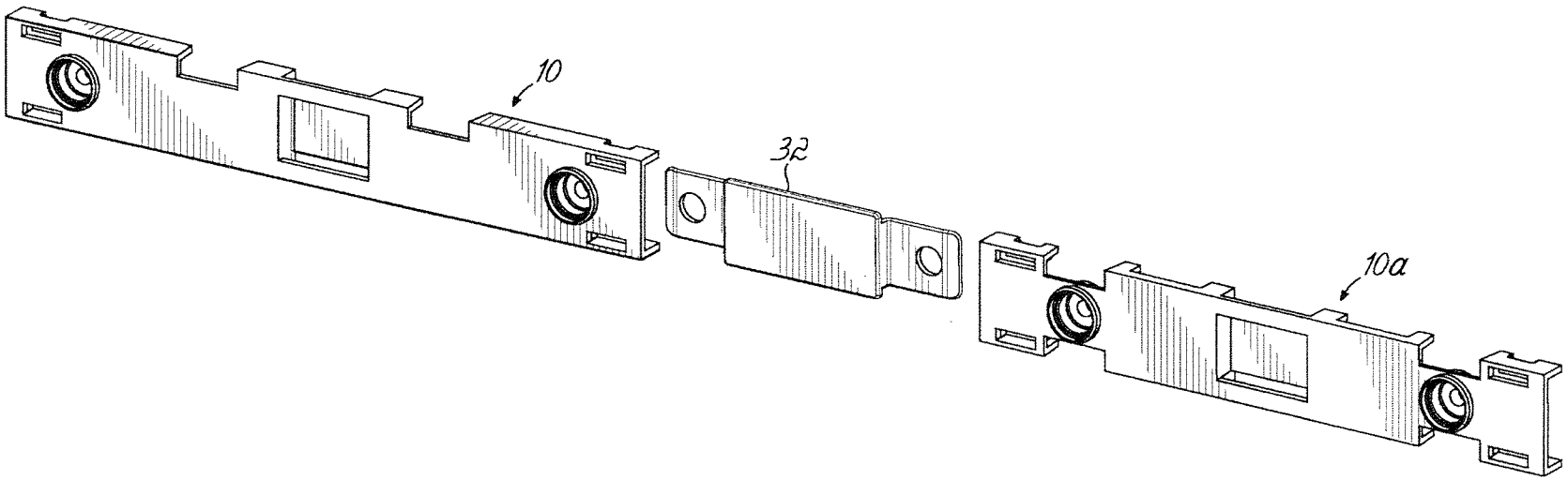
FIG. 4 is an isometric view of a dispenser mounting rail, a horizontal rail connector and a chemical cabinet mounting rail shown in exploded view for clarity.
Figure 4A:
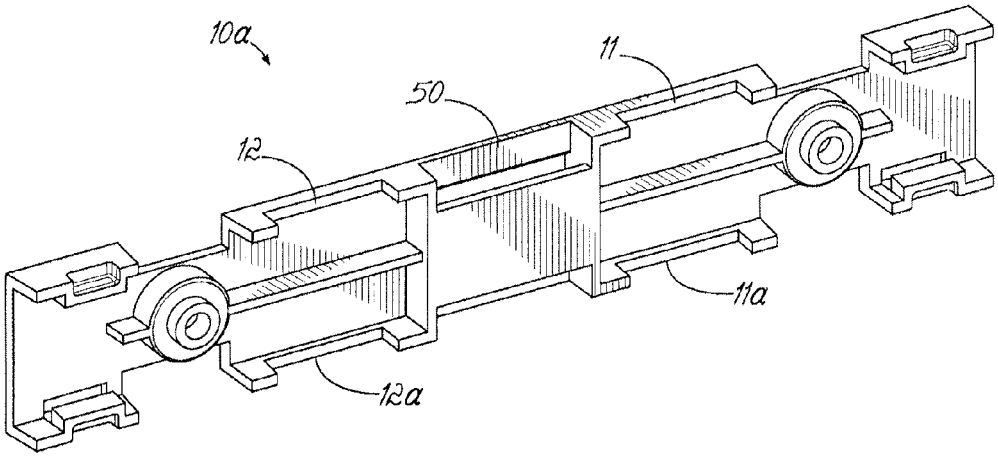
FIG. 4A is an isometric view of a chemical cabinet mounting rail as in FIG. 4, but showing the rail from its back side or wall side.
Figure 4B:
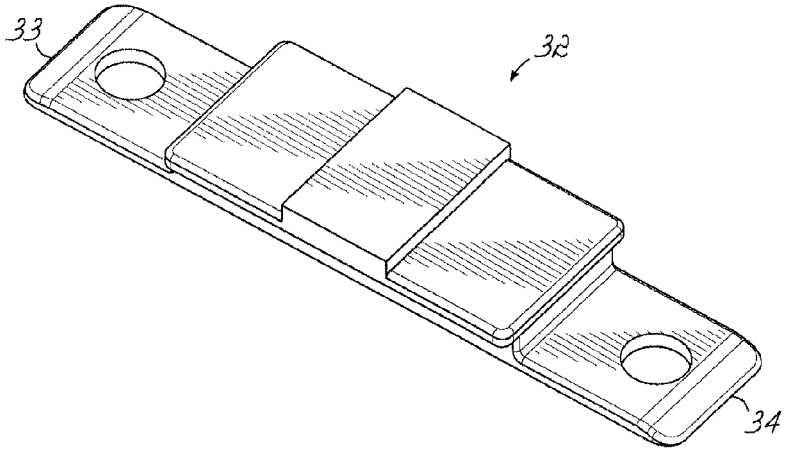
FIG. 4B is an isometric view of the rail connector of FIG. 4.

FIG. 4 shows one mounting grid according to the invention in exploded format including a dispenser mounting rail 28, chemical cabinet mounting rail 30 and horizontal connector 32. See FIG. 4A for a rear view (from the wall side) of the chemical cabinet mounting rail. The connector 32 (see FIG. 4B) has ends 33, 34 which are releasably connectable to abutting ends of the respective rails 10, 10A in any suitable fashion. When interconnected, such as by snapping these components together, a formed horizontal grid is formed as in FIG. 5. It will be appreciated that rails 10, 10A are very similar with only slight spacing differences as shown, one (10) being configured for a dispenser cabinet or model 18 and the other (10A) configured for a chemical source cabinet or module 18A (FIG. 6).

It will be appreciated that horizontal mounting rails 10, 10A do not extend outwardly of the width profile of the cabinet they mount. When side-by-side cabinet mounting is desired, the connectors 32 are used to properly space the mounting rails for side-by-side cabinet orientation and the rails 10, 10A do not protrude outwardly of the cabinet width profile.

Moreover, note the lock notches 11, 12 of the chemical cabinet or module mounting rail 10A which provide clearance for the cabinet locks as will be described. Lock notches 11, 12 and 11A, 12A are similar in the respective rails.

Figure 6:
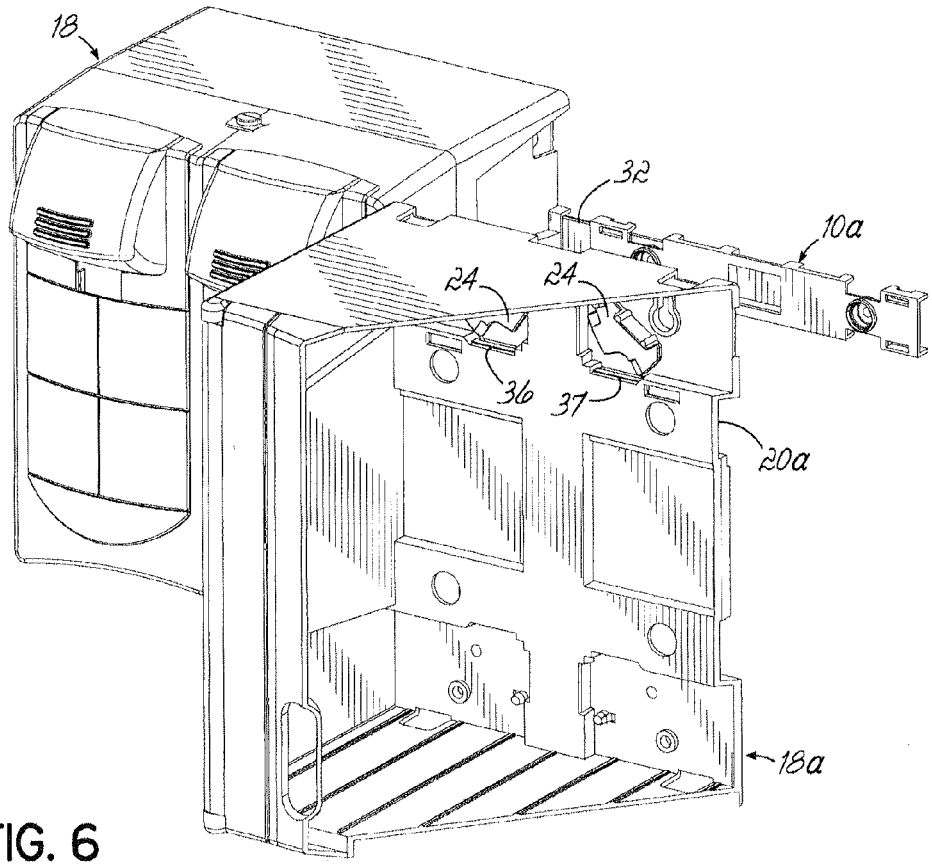
FIG. 6 is a view similar to FIGS. 2 and 3 but with the addition of a cut-away view of a concentrate chemical cabinet for mounting on a connected horizontal rail such as shown in FIG. 5 and with mounting locks disengaged.

FIG. 6 illustrates a mounting dispenser assembly module 18 with a to-be-mounted chemical cabinet or module 18A on its respective mounting rails 10, 10A. Two mounting locks 24 are shown in disengaged position in module 18A. These are disposed to turn downwardly into notches 11A, 12A in rail 10A to secure module 18A to rail 10A, and through access holes 36, 37 in channel 20A.

Figure 6A:
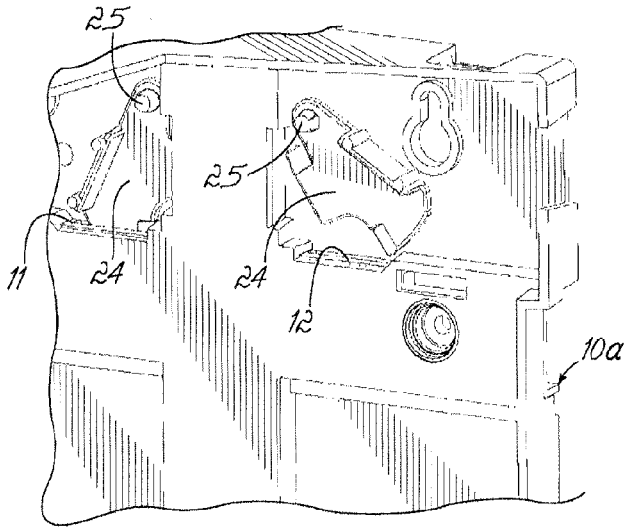
FIG. 6A is an isometric line drawing cut-away view of a portion of a mounted cabinet and respective rail locks, the left lock engaged and the right lock disengaged.

FIG. 6A illustrates one of the mounting locks 24 (left side in FIG. 6*a*) rotated to engaged position and the other lock 24 (right side of FIG. 6A) in disengaged position.

Figure 6B:
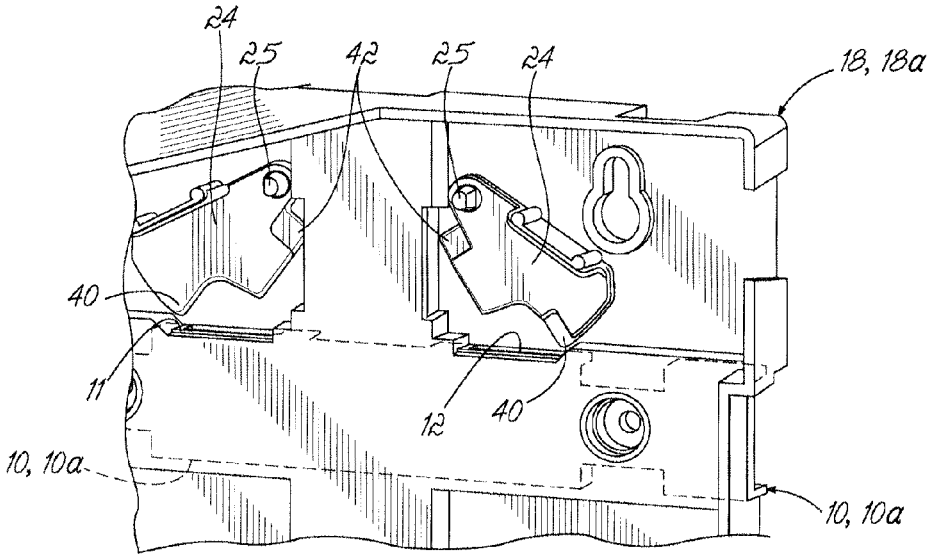
FIG. 6B is an isometric view of the internal cabinet side of a cabinet, on a rail and two disengaged locks.
Figure 6C:
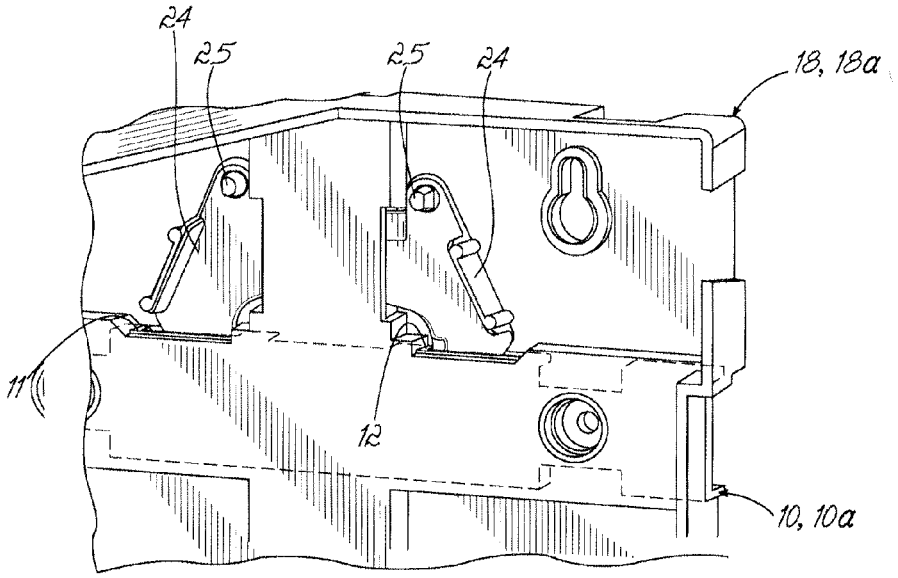
FIG. 6C is an isometric view similar to FIG. 6*b* but showing the locks engaged behind the rail.

FIGS. 6B and 6C illustrate disengaged and engaged mount locks in more detail. When engaged, a lock portion 40 of each extends into the respective lock notch 11, 12 of a rail 10, 10A, and behind the rail as shown in these FIGS. This interferes with the rear surface of the rail, preventing the cabinet from being pulled outwardly away from the rail. When the cabinet door is locked, access to the cabinet interior as well as locks 24 is secured and neither the cabinet modules 18, 18A, nor the interior contents can be removed.

Figure 6D:
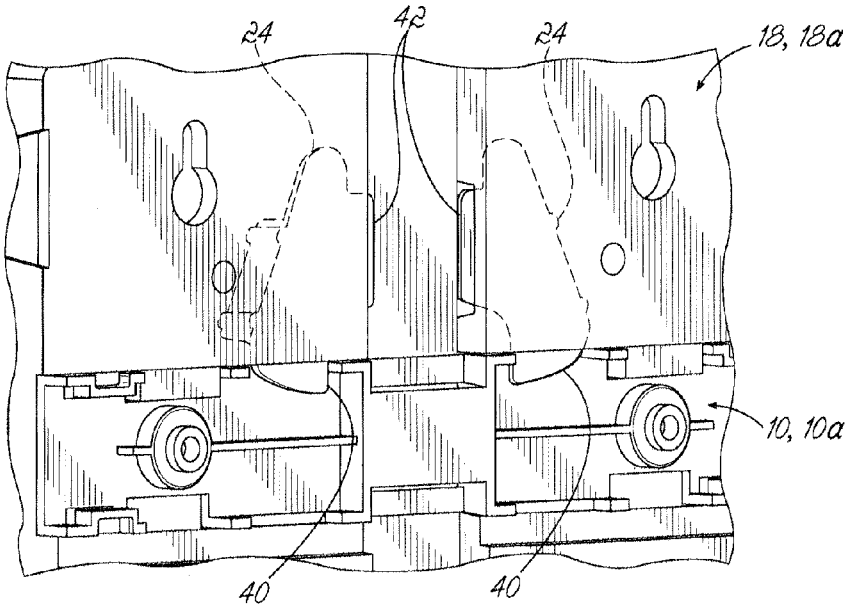
FIG. 6D is an isometric view of the subject of FIGS. 6-6*c*, but taken from the "wall side" or rear of the rail and locks.

FIG. 6D illustrates the cooperation of module, lock and rail from the perspective of the wall side.

Also note the rotatable lock has tabs 42 for engaging behind lock notches 24 in a vertical spacer, where that is used, to further lock the cabinet, as will be described. For purposes of FIGS. 6-6D, it will be appreciated that but for slightly different spacing, the lock structures and functions are similar for modules 18 and rail 10 and for modules 18A and rails 10A.

Figure 7:
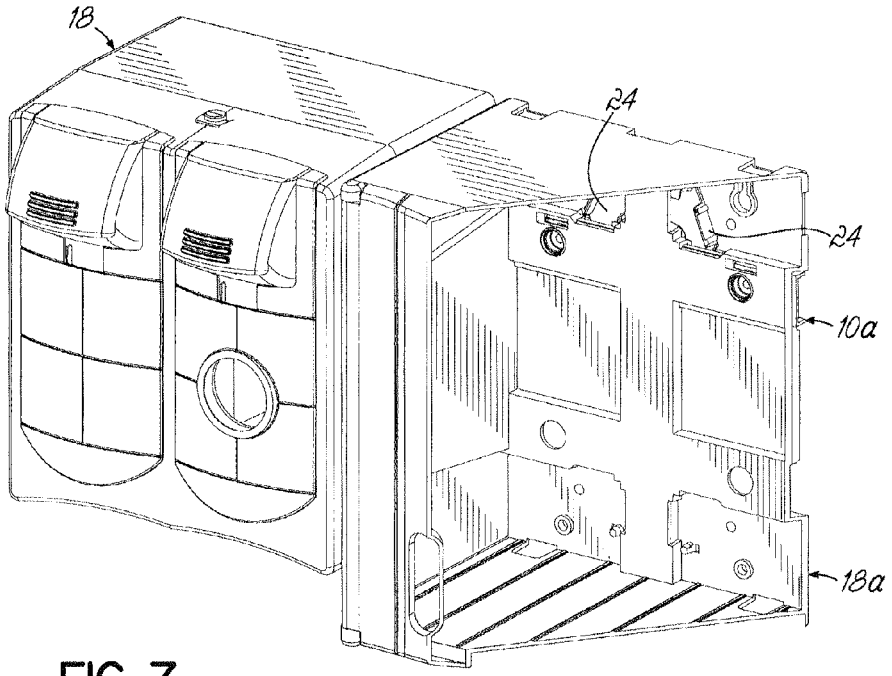
FIG. 7 is a cut-away isometric view similar to FIG. 6 showing both mounting locks engaged.

FIG. 7 illustrates the chemical cabinet or module locked to a mounting rail alongside a dispenser assembly where all locks are engaged to respective rails 10, 10A from modules 18, 18A.

Turning now to FIGS. 8-13D, a variety of but a few grid and module orientations contemplated by the invention are respectively illustrated.

Figure 5:
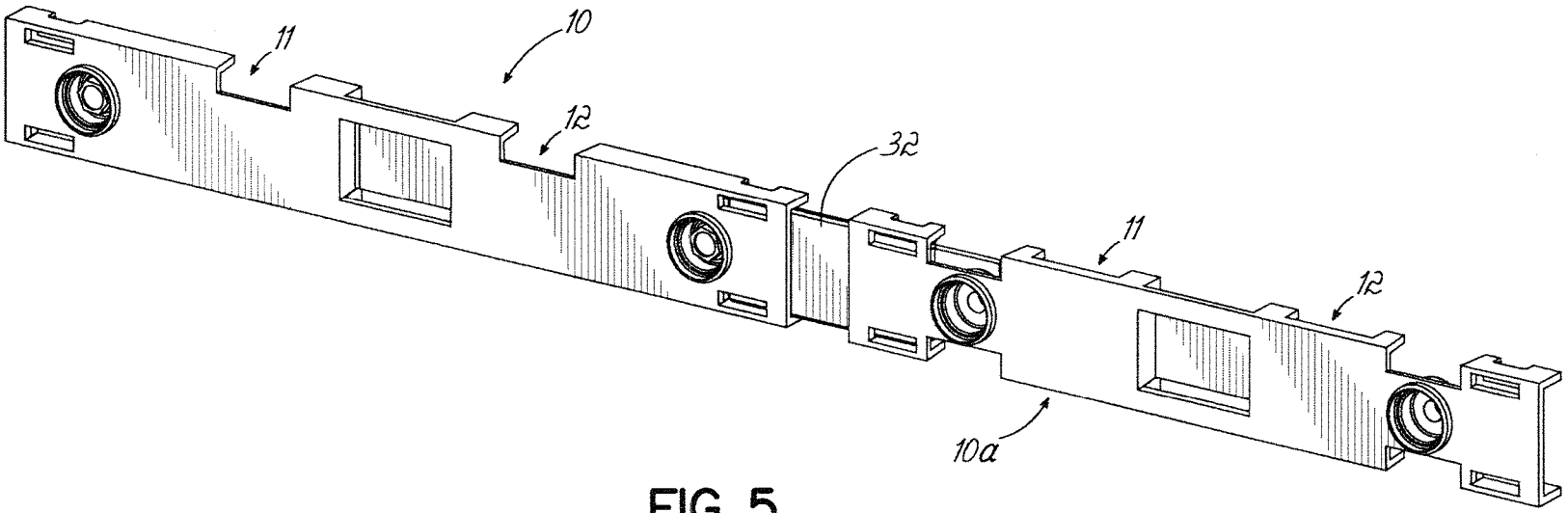
FIG. 5 is a view similar to FIG. 4 but showing the rails in inter-connected relation.
Figure 8:
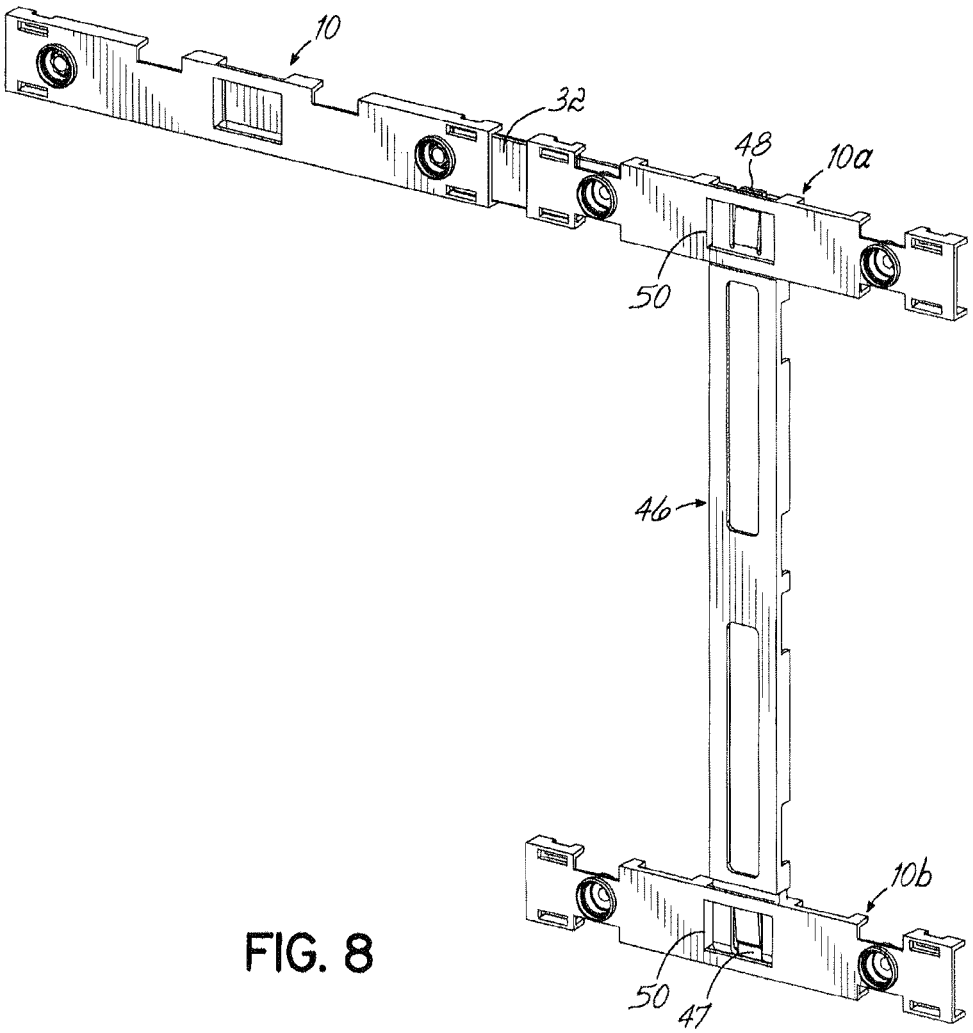
FIG. 8 is an isometric view of but one configuration of a plurality of horizontal rails, vertical spacers and connectors.
Figure 8A:
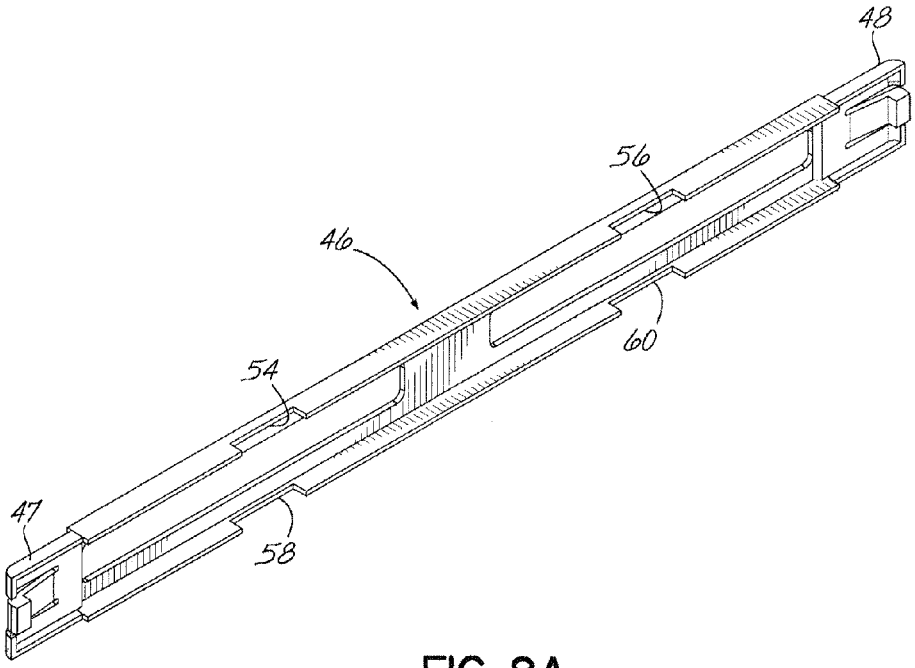
FIG. 8A is an isometric view of a vertical spacer from its rear or wall side.

In FIG. 8, a dispenser mounting rail 10 is horizontally joined to a chemical cabinet mounting rail 10A as in FIG. 5. A further, lower, chemical cabinet mounting rail 10B is spaced below these by means of a vertical connector 46. Rail 10B is identical to rail 10A and similar to rail 10 as noted above. This connector is shown separately in more detail in FIGS. 8A and 8B. The vertical connector 46 (spacer) has universal ends 47, 48, snappable into receiving structure or receptacle 50 in the cabinet rail 10 (shown here and in FIG. 4A). The length of vertical connector 46 is predetermined so that chemical source cabinets can be vertically oriented in combination, the cabinets essentially one atop another. It will be appreciated the cabinet contains a vertical channel 52 (FIG. 11A) for receiving the vertical spacers 46 where those are used.

Figure 8B:
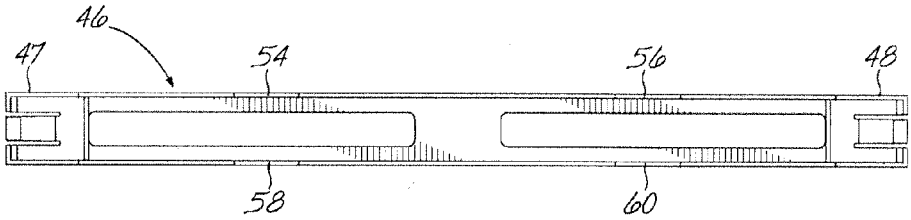
FIG. 8B is an elevational view of the vertical spacer of FIG. 8A.

The vertical connector 46 has lock notches 54, 56 for accepting the tabs 42 of the rotatable locks described above as well as opposed lock notches 58, 60 (FIG. 8B). The lower chemical cabinet mounting rail is identical to the rail 10A above it, as shown.

It will be appreciated the length of vertical connectors 46 is coordinated with the height of modules 18, 18A to be mounted thereon, such that horizontal rails 10, 10A are positioned in parallel, and to cooperate with the horizontal channels 20, 20A in the respective modules.

Figure 9:
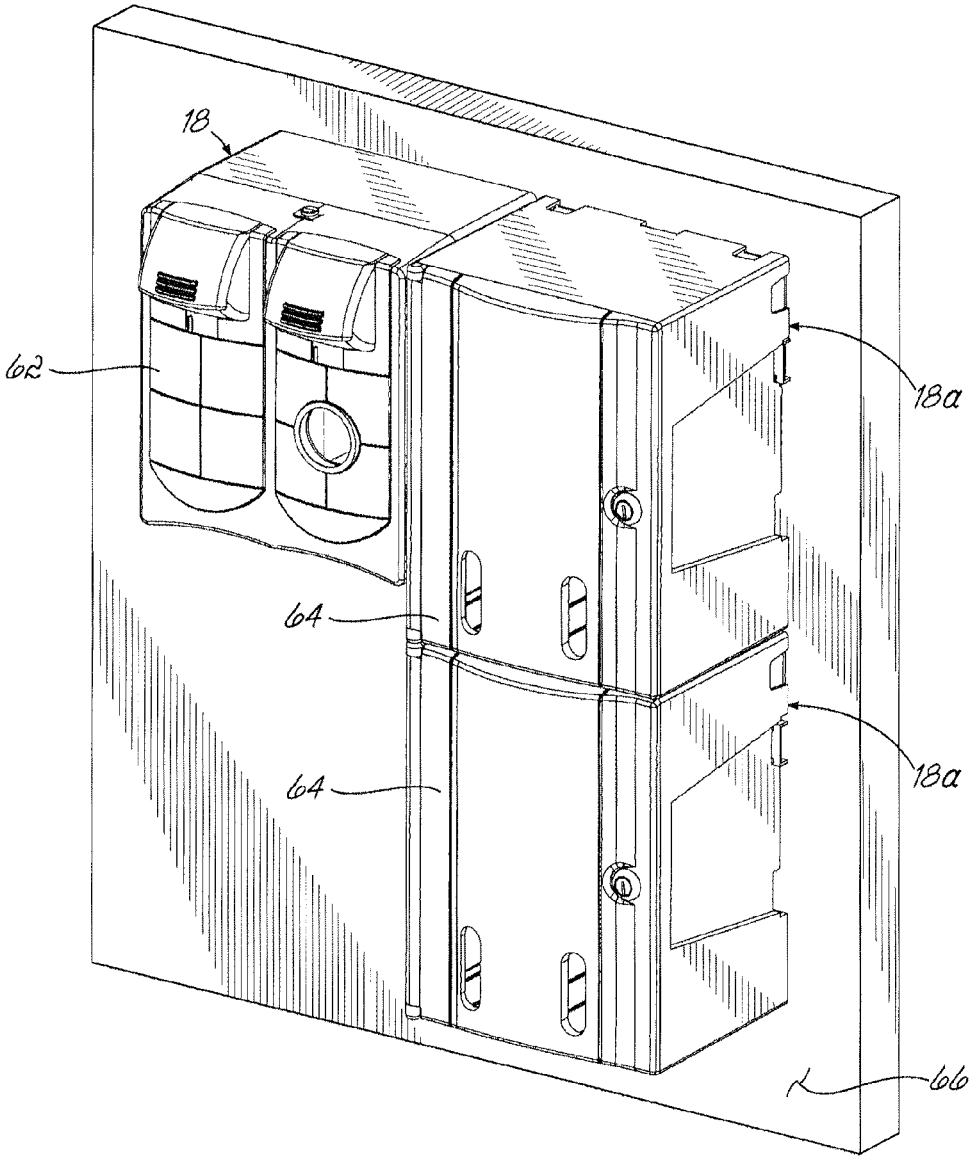
FIG. 9 is an isometric view of a dispenser cabinet and two concentrated chemical cabinets as would be mounted on the rail grid of FIG. 8.

FIG. 9 illustrates dispensing 18 and chemical 18A cabinets respectively mounted on the grid shown in FIG. 8, the cabinets or modules 18 have snap-on doors 62. Modules 18A having lockable doors 64 preventing unauthorized access to their contents and removal of the chemicals. A wall surface 66 of indeterminate size is shown in FIG. 9 for clarification.

Figure 10:
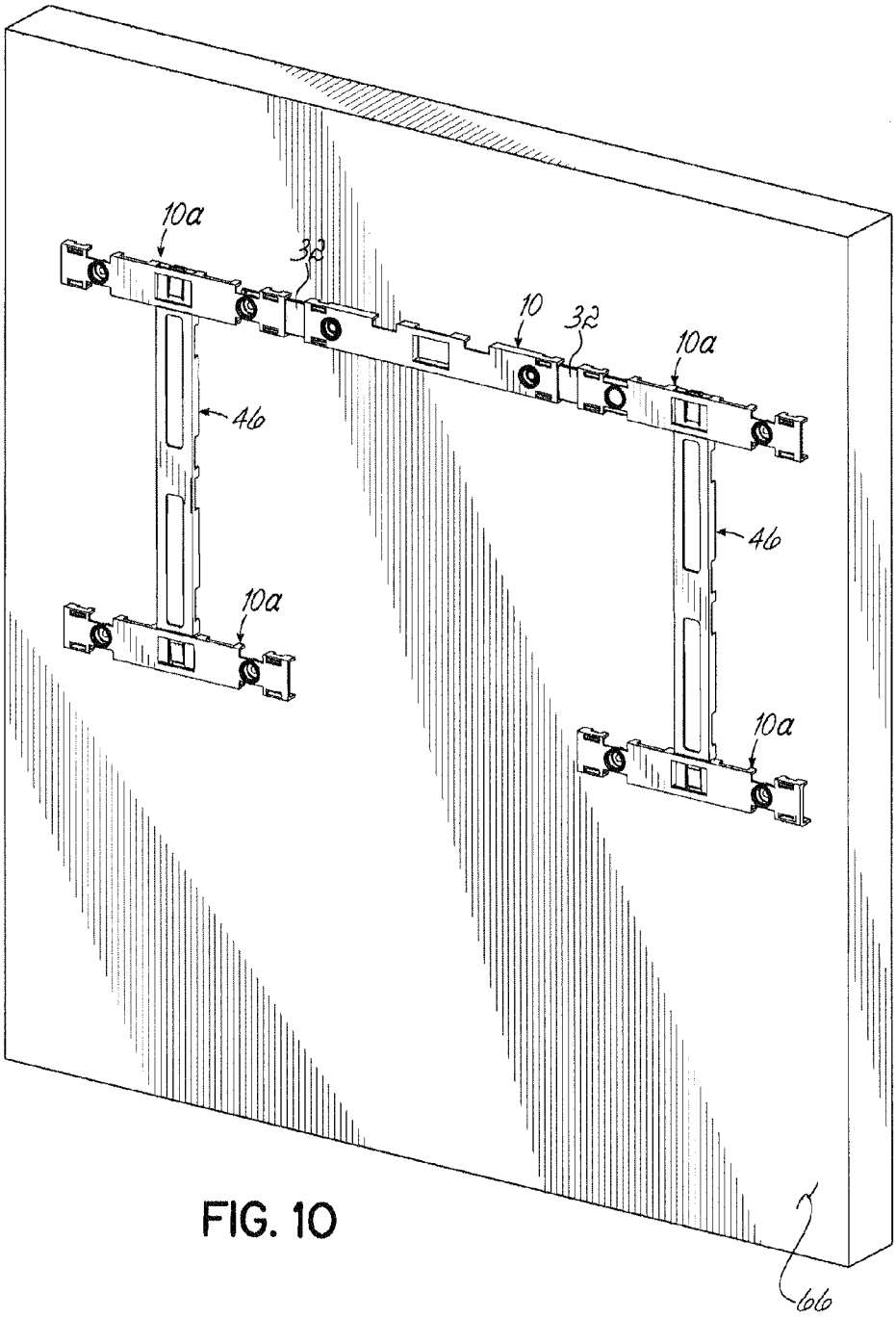
FIG. 10 is an isometric illustration of another rail grid configuration.
Figure 11:
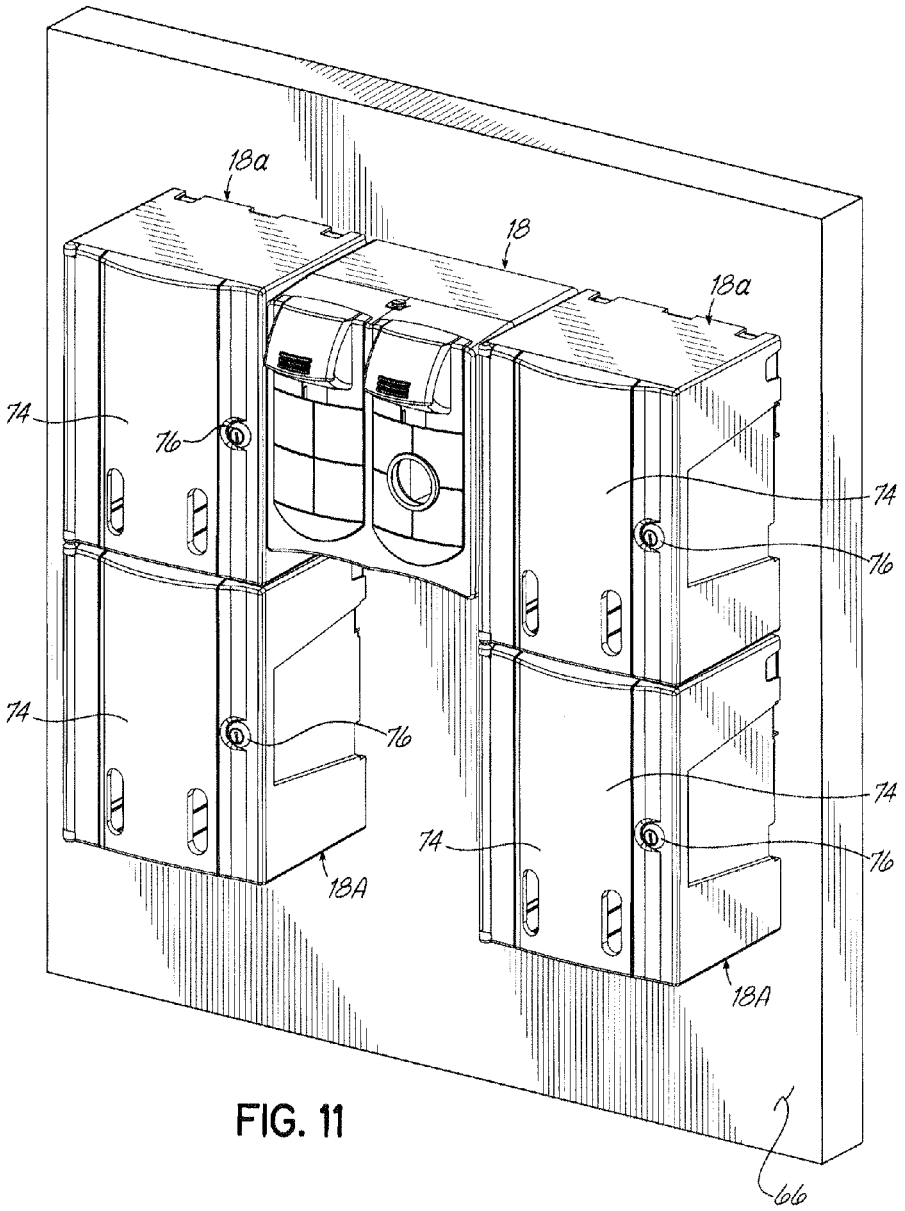
FIG. 11 is an isometric view of a dispenser assembly and concentrated chemical cabinets as would be mounted on the rail grid of FIG. 10.

FIGS. 10 and 11 illustrate another of the variety of mounting rail grids, connectors and cabinets or modules having same construction as noted above, but in a different respective configuration.

In FIGS. 10 and 11, a dispenser module 18 is mounted on a rail 10. Two first chemical source modules 18A are respectively mounted on either side of dispenser 18 on rails 10A. Two further second chemical source modules 18A are mounted respectively beneath the first chemical modules 18A on lower rails 10A. Each lower rail 10A is mounted beneath a parallel rail 10A thereabove, and spaced therefrom by a vertical connector 46. The two upper rails 10A are connected to center rail 10 via horizontal connector 32 for spacing.

It will be appreciated that dispenser module 18 has one or more snap-on doors as shown. Modules 18A have doors 74 (like doors 64 of FIG. 9) provided with respective locks 76. Locks 24 in each module are accessible only by way of access to the modules 18A through lockable doors 74.

From FIGS. 8-11, it will be appreciated that a variety of cabinet configurations can be provided. The installer applies a mounting grid of rails to a wall or other surface using the rails and connectors to define the "footprint" of the desired system. These components are easily applied to the wall and automatically space or define the final cabinet positions. Thereafter the cabinets or modules are secured to the rails (and any relevant vertical connectors) in desired orientation and the system is thus configured for a large variety of available mounting spaces.

Figure 11A:
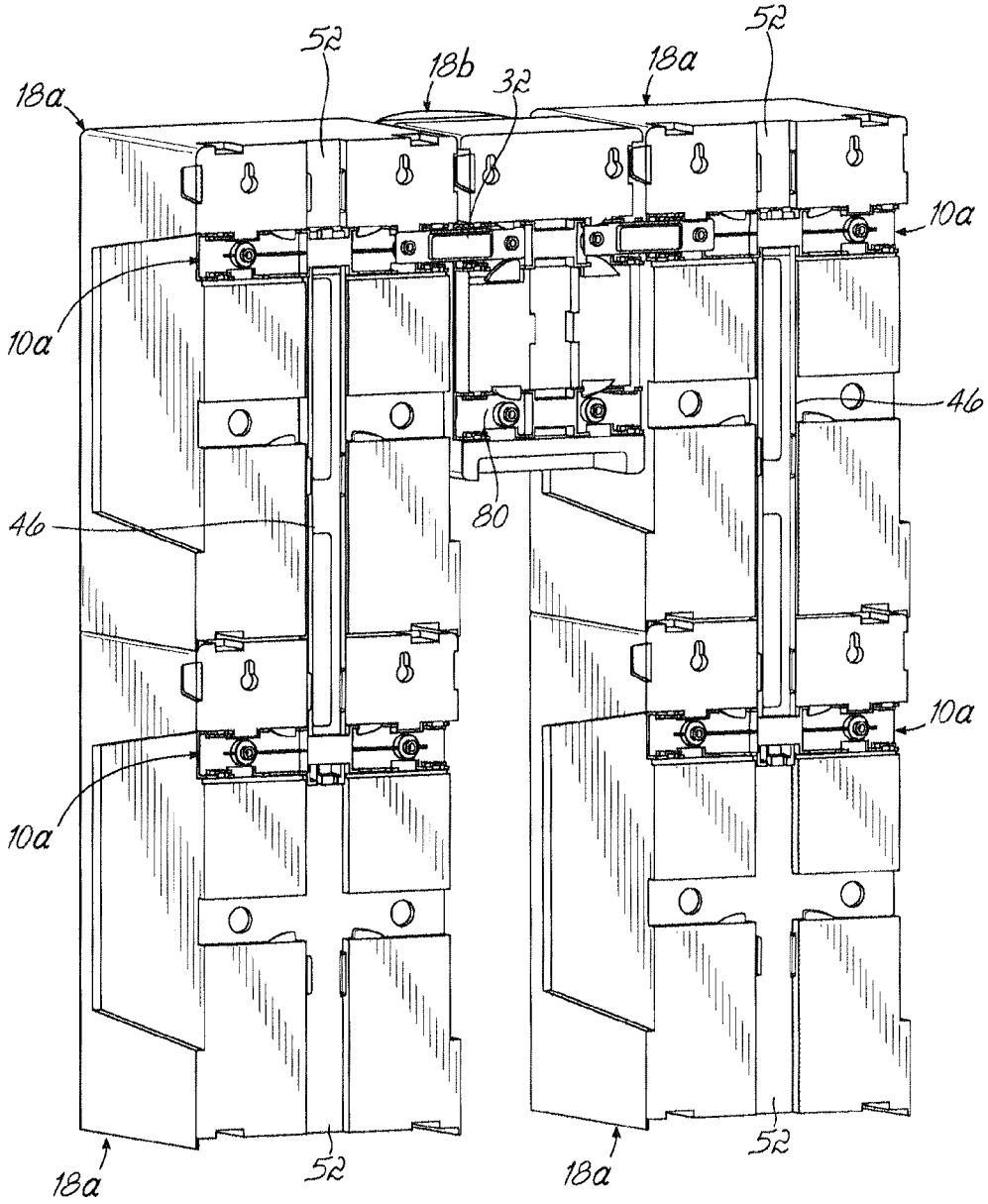
FIG. 11A is an isometric rear view of a mounted dispenser assembly and chemical cabinets similar to that of FIG. 11, but where a single button dispenser is used.
Figure 11B:
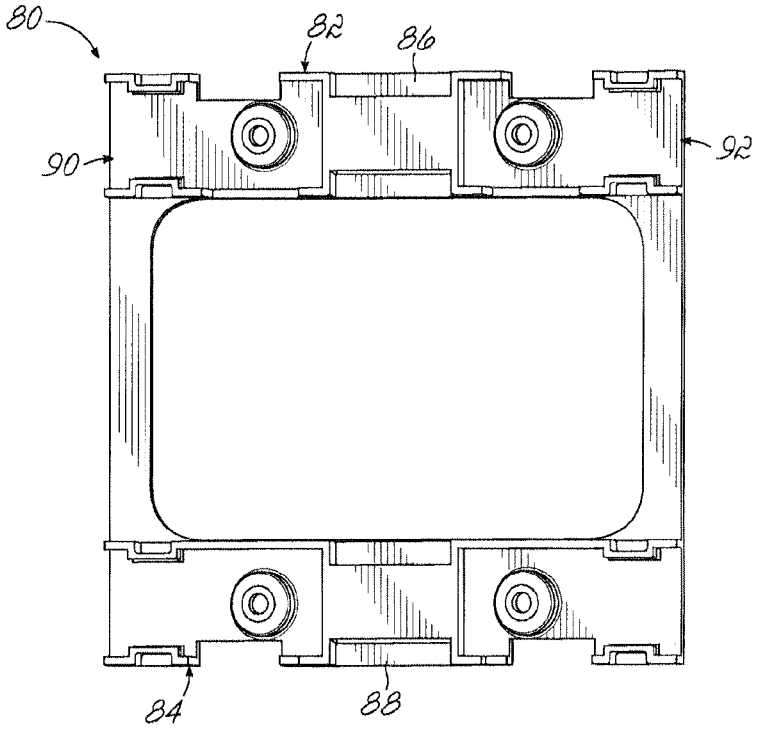
FIG. 11B is an elevational rear view of a mounting rail frame for use with single button dispenser as in FIG. 11A.
Figure 11C:
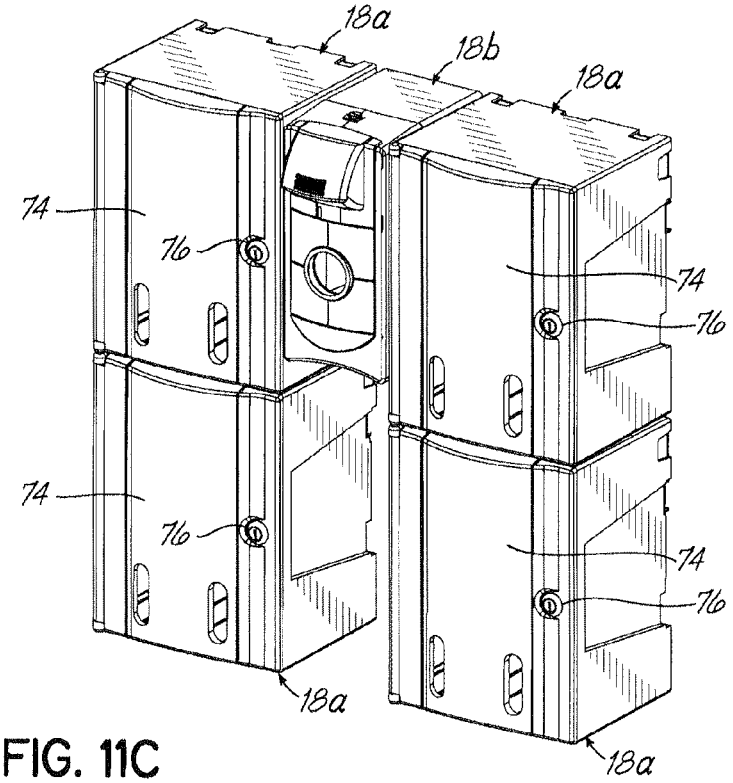
FIG. 11C is an isometric view of a one-button dispenser assembly as in FIG. 11A.
Figure 12A:
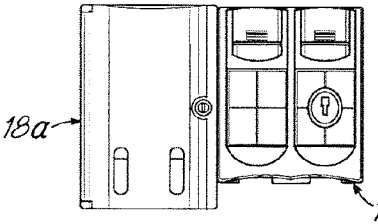
FIGS. 12A-12E are elevational views of but a few of the module orientations of the invention, illustrating a variety of mounting configurations and module orientations.
Figure 12B:
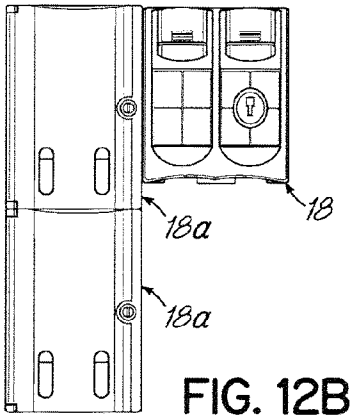
Figure 12C:
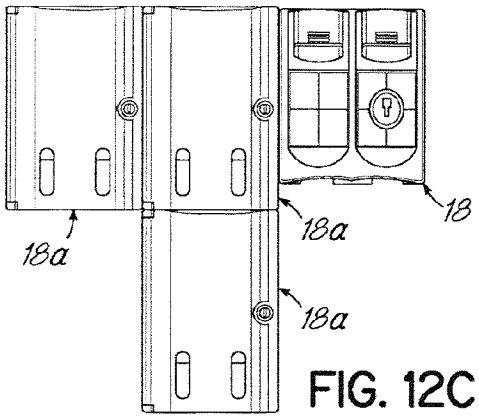
Figure 12D:
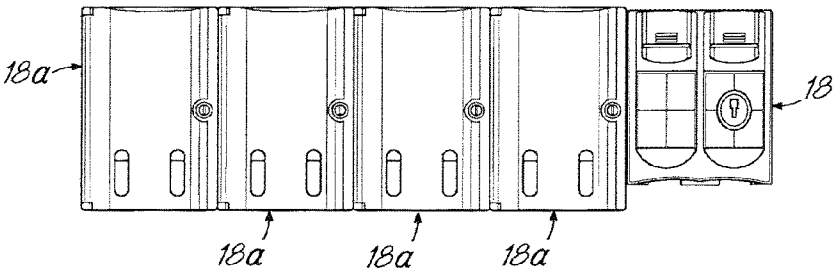
Figure 12E:
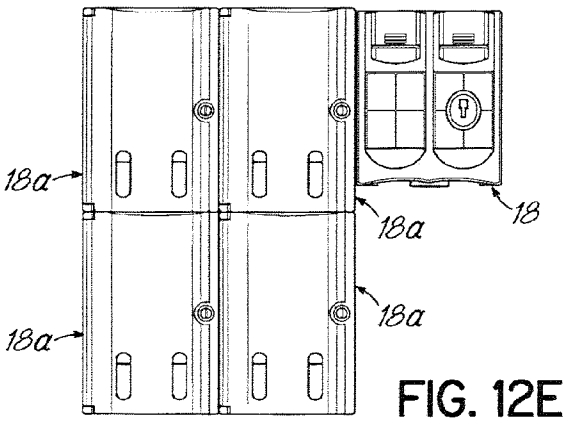

In FIGS. 11A-11C, there is disclosed a modular dispensing mounting system according to the invention wherein a single button dispenser may be used. Instead of a single horizontal mounting rail 10, a one-button dispenser mounting rail frame 80 (FIG. 11B) is used. Such frame 80 is easily incorporated into the single rail grid of the foregoing embodiments and is incorporated in the term "mounting rail".

With attention to FIG. 11B, rail frame 80 includes upper and lower frame components 82, 84, each with a single locking notch 86, 88 for a respective lock member 24 (not shown) mounted in a dispenser module 18B.

At least upper component 82 has opposite ends 90, 92 configured to accept horizontal connectors 32 as desired. Lower component 84 has similar structural and functional ends.

Such a rail frame 80 is used as in FIG. 11A in cooperative grid with rails 10A on either side of upper component 82 (and connectors 32). Rails 10A are connected to respective lower rails 10A through respective vertical connectors 46 as in FIG. 10.

Accordingly, a single button dispenser is mounted between two upper chemical source modules 18, which are mounted above two respective further chemical source modules 18A as in FIG. 11C.

Other configurations of FIGS. 12A-12E and 13A-13D illustrate a few of the many other available configuration installations.

It will be appreciated that the rail grid components can be combined in a large variety of configurations to securely mount modules, such as dispenser and chemical source modules 18, 18A in a wide variety of positions to accommodate a wide variety of available footprint or wall space.

Moreover, it will be appreciated that each module preferably includes structure such as channels 20, 20A to receive the respective horizontal rails or frame members 10, 10A and 80. Also, one or more locks 24 disposed within the modules can be operated to secure the respective modules to the rails (and the support wall) by rotation through such channels to engage the rails through the locking notches therein.

In the same fashion, the modules 18, 18A may include vertical channels to receive portions of the vertical connectors 46 when the configuration desired requires it. Lock tabs 42 can be rotated into locking notches in the vertical rails as well to likewise secure the modules thereto.

It will also be appreciated that accommodations in the modules can be made in any suitable way, such as access openings, to accommodate tubes, conduits, hoses or the like between the dispenser modules 18 and the chemical source modules 18A to provide chemical flow therebetween.

As a result, system mounting is greatly simplified and one grid and cabinet system is used to fit a large variety of applications, both with respect to available mounting space and to required system parameters such as multiple chemical sources. The invention provides a clean look and is customizable on site. Overall costs attending custom design and fabrication of parts are eliminated, and security is provided.

It will be appreciated herein that the terms "cabinet" and "module", when referring to the invention only, are used interchangeably herein.

What is claimed is:

1. A modular dispenser mounting apparatus for mounting a dispenser module to a mounting wall, comprising:

a dispenser module;

a plurality of elongated horizontal dispenser module mounting rails attachable to said wall;

a plurality of spaced apart vertical connectors extending between two parallel mounting rails;

at least two of said rails having ends spaced horizontally from said vertical connectors;

at least one horizontal connector for connecting together adjacent ends of said at least two of said plurality of horizontal mounting rails at positions spaced between said vertical connectors;

said horizontal connector extending in a direction parallel to extension of said elongated horizontal mounting rails;

a lock mounted on said dispenser module rotatable with respect thereto; said lock having portions rotatable with respect to said mounting rails and releasably engaging at least one of said horizontal mounting rails and securing said module onto said at least one rail.

2. Apparatus as in claim 1 wherein said vertical connectors have respective ends, each end interconnectable with a respective parallel horizontal mounting rail.

3. A universal modular dispensing system, comprising;

a dispenser assembly module;

at least one mounting rail;

said module having at least one transverse mounting rail receiving channel;

further including a rotatable lock in said module for engaging said mounting rail and securing a respective module thereto, and said lock rotatably mounted on said module and being rotatable with respect to said nodule and rotatable with respect to a respective rail to secure said module to said rail, and further comprising at least one locking notch in at least one of said rails;

said rotatable lock in said module being rotatable into a respective locking notch and into locking position with a within said respective notch.

4. A system as in claim 3 wherein respective ones of said rails define a locking notch for receiving said rotatable lock and said module comprises a transverse channel receiving a respective rail when said module is disposed on a wall surface by said rail.

5. A system as in claim 3 including at least two horizontal rails and a connector member extending between said two rails.

6. A system as in claim 5 wherein said two rails each have two locking notches therein, the notches in one of said rails being oriented a distance apart different from the distance between locking notches in another said rail.

7. A system as in claim 3 further including at least one other rail extending perpendicular to said at least one rail.

8. A system as in claim 7 wherein said at least one other rail comprises a socket for receiving an end of said at least one rail.

9. A rail apparatus for mounting a dispenser module on a wall surface; said apparatus comprising:

a plurality of horizontal mounting rails;

a plurality of spaced apart vertical connectors oriented perpendicularly and connected to respective ones of said horizontal mounting rails;

two of said plurality of horizontal rails extending in a same horizontal direction and each having a respective end adjacent the respective end of another;

a horizontal connector connected between said respective ends at a position between two of said vertical connectors.

10. Apparatus as in claim 9 wherein said two horizontal rails have spaced locking notches for receiving a rotatable locks of a module, spacing between said locking notches in one rail being different from spacing between locking notches in another rail.

* * * * *

UNITED STATES PATENT AND TRADEMARK OFFICE

CERTIFICATE OF CORRECTION

PATENT NO. : 9,096,417 B2
APPLICATION NO. : 12/899143
DATED : August 4, 2015
INVENTOR(S) : William F. Sand It is certified that error appears in the above-identified patent and that said Letters Patent is hereby corrected as shown below:

In the Specification:

Column 1, line 26, after the word "as" delete ",".
Column 1, line 49, "Ohio," should be ---Ohio.---.
Column 2, line 15, after the word "over" delete "the".
Column 3, line 44, "concentrate" should be ---concentrated---.
Column 4, line 28, "complimentary" should be ---complementary---.

In the Claims:

Column 7, line 54, "comprising;" should be ---comprising:---.
Column 8, line 7, "nodule" should be ---module---.
Column 8, lines 15-16, "position with a within said respective notch" should be ---position within said respective notch---.
Column 8, line 47, after "receiving" delete "a".

Signed and Sealed this
Thirty-first Day of May, 2016

Michelle K. Lee

Michelle K. Lee
*Director of the United States Patent and Trademark Office*